United States Patent [19]

Oen

[11] Patent Number: 4,643,468

[45] Date of Patent: Feb. 17, 1987

[54] LATCHING ARRANGEMENT AND METHOD

[75] Inventor: Joshua T. Oen, Castro Valley, Calif.

[73] Assignee: Paccar, Inc., Bellevue, Wash.

[21] Appl. No.: 735,675

[22] Filed: May 20, 1985

[51] Int. Cl.[4] ..... E05C 19/00; E05F 5/00

[52] U.S. Cl. ..... 292/2; 292/DIG. 38; 29/428

[58] Field of Search ..... 403/5, 248, 277, 297; 292/1, 2, 144, 201, 49, DIG. 38, 14; 29/428

[56] References Cited

U.S. PATENT DOCUMENTS

| | | | |
|---|---|---|---|
| 2,319,504 | 5/1943 | Holman | 292/1 |
| 2,743,601 | 5/1956 | Dlugatch | 70/240 |
| 3,596,484 | 8/1971 | Peters | 70/240 |
| 3,599,743 | 8/1971 | Hull | 70/240 |
| 3,601,434 | 8/1971 | Fargo | 70/240 |
| 3,633,390 | 1/1972 | Wartian | 70/240 |
| 3,669,481 | 6/1972 | Bergmann | 292/49 |
| 3,831,409 | 8/1974 | Gebhard et al. | 70/241 |
| 3,971,580 | 7/1976 | Tantlinger et al. | 292/201 |
| 4,441,345 | 4/1984 | Guarr | 70/240 |
| 4,458,774 | 7/1984 | Sieren | 292/120 |

FOREIGN PATENT DOCUMENTS

| | | | |
|---|---|---|---|
| 2659560 | 7/1978 | Fed. Rep. of Germany | 403/5 |

*Primary Examiner*—Richard E. Moore

*Attorney, Agent, or Firm*—Flehr, Hohbach, Test, Albritton & Herbert

[57] ABSTRACT

An arrangement for latching and unlatching the hood of a motorized vehicle is disclosed herein. This arrangement utilizes a fluid inflatable component carried by a base member of the vehicle and a second component defining an externally accessable cavity carried by the hood. The hood may be closed while the inflatable component is in a deflated state. As it does so, the deflated component is caused to enter the cavity of the component carried by the hood. Thereafter, the inflatable component is inflated sufficient to prevent its removal from the cavity, thereby latching the hood in its closed position.

9 Claims, 8 Drawing Figures

LATCHING ARRANGEMENT AND METHOD

The present invention relates generally to latching arrangements and more particularly to a specifically designed arrangement especially suitable for latching and unlatching the hood of a motorized cab or other such vehicle.

Two basic theories in hood mounting systems presently exist. One such system utilizes what may be referred to as a positive restraining technique wherein, for example, a male probe is caused to mate into a matching cavity. The other system utilizes a blade in a cooperating slot. A primary advantage in using positive restraining techniques is that it provides locational control. On the other hand, the blade and slot approach allows the hood to move freely to a limited extent relative to the rest of the cab. A disadvantage to the probe/cavity approach is that its use may result in alignment problems. More specifically, if the mating parts are not properly aligned, excess friction and jamming may occur, resulting in the necessity to provide relatively high opening and closing forces to open and close the hood. A disadvantage in utilizing the blade and slot approach is that it results in excessive hood motion (self destruction).

In view of the foregoing, it is a primary object of the present invention to provide a latching arrangement which is especially suitable for latching and unlatching the hood of a motorized vehicle (but not necessarily limited thereto) and which displays many of the advantages of the systems described above without the disadvantages.

A more specific object of the present invention is to provide a latching arrangement which provides positive location of the members to be latched, while at the same time minimizing alignment problems and allowing for relative movement of the members to a limited extent (while retaining a latched condition).

Another particular object of the present invention is to provide a latching arrangement which eliminates frictional problems during the latching and unlatching operation of the arrangement.

As will be described in more detail hereinafter, the latching arrangement disclosed herein is particularly suitable for use in an apparatus including first and second members, at least one of which is movable relative to the other such that the members can be placed in one position adjacent each other or another spaced-apart position. An example of such an apparatus is a motorized vehicle in which one of the members is a fixed base and the other is a movable hood. In accordance with the present invention, the latching arrangement utilizes means including a fluid inflatable component carried by the first member, for example the base of the vehicle, the component being designed to operate between inflated and deflated conditions. The arrangement also utilizes means defining an externally accessible cavity carried by the second member, for example the hood, for receiving the inflatable component within the cavity when this latter component is in its deflated condition and the first and second members are adjacent to one another, for example when the hood is closed. The inflatable component and the cavity are configured such that the two cannot be separated from one another readily when the inflatable component is in its inflated condition within the cavity. At the same time, means are provided for controllably inflating and deflating the inflatable component whereby to latch and unlatch the members.

The foregoing objects and other objects and features of the present invention will become more apparent hereinafter from the following detailed description in conjunction with the drawings wherein.

Figure 1:
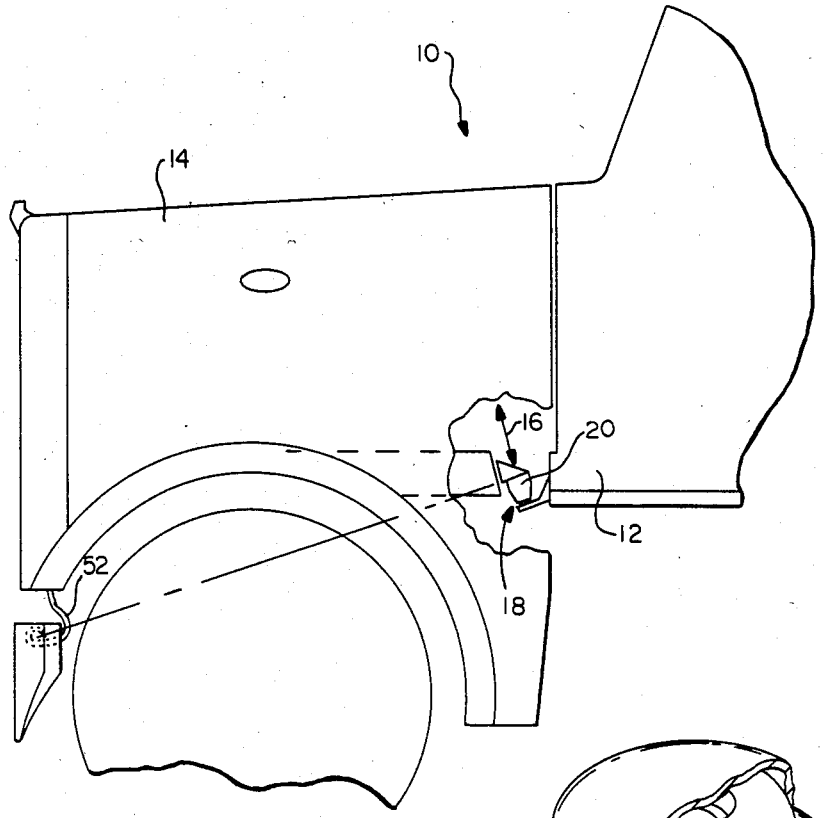
FIG. 1 is a side elevational view of part of a motorized vehicle, specifically the hood of a truck cab including a hood latching arrangement designed in accordance with the present invention.
Figure 2:
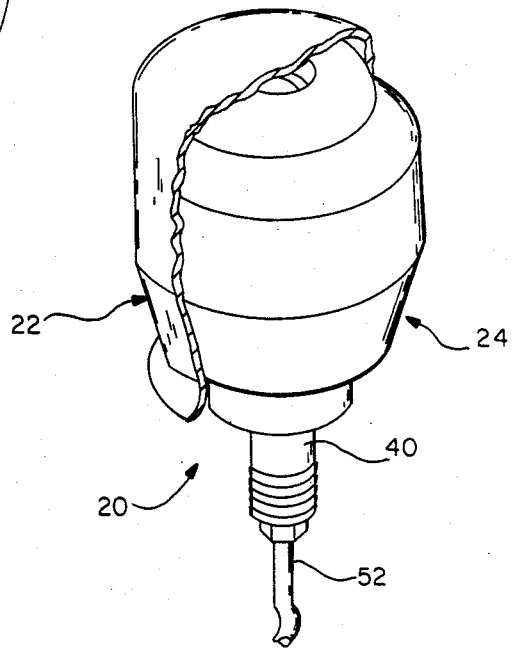
FIG. 2 is a partially broken away perspective view of the latching arrangement of the present invention shown in a latched state.
Figure 2:
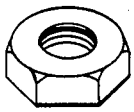
Figure 3:
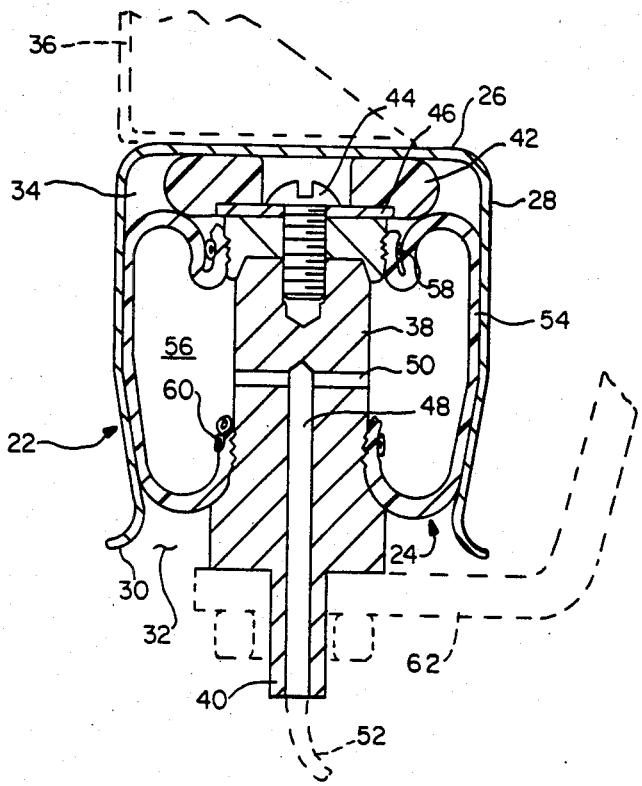
FIG. 3 is a vertical cross sectional view of the latching arrangement of FIG. 2, also shown in a latched state.

Turning now to the drawings, wherein like components are designated by like reference numerals throughout the various Figures, attention is first directed to FIG. 1. This Figure illustrates a part of the cab 10 of a truck including a main cab body 12 and a hood 14 which is supported at 52 for pivotal movement in the direction of arrow 16 between the closed position shown in FIG. 1 and an opened position. The cab also includes a latching arrangement which is generally indicated at 18 and which is designed in accordance with the present invention to latch the hood 14 in and unlatch it from its closed position. As will be described in more detail hereinafter, the latch arrangement disclosed includes what may be referred to as a pneumatic latch 20 and means to be discussed specifically with regard to FIG. 7 for pneumatically actuating the latch. FIGS. 2 and 3 provide a more detailed illustration of the latch which is shown to include a housing 22 and an air bag assembly 24.

Referring specifically to FIGS. 2 and 3, the housing 22 which is constructed of suitable rigid material has a top end 26 and a circumferentially extending side wall 28 depending from top end 26 and opening outwardly in order to define a circumferential tape 30 at its bottom end. Taper 30 defines an inlet 32 into an internal cavity 34 (see FIG. 3) which is defined by the housing and which is made accessable to the external surroundings of the housing by inlet 32. As best illustrated in FIGS. 1 and 3, the housing is fixedly connected by any suitable means, for example adhesive or bolts (not shown) to an angled flange 36 which, in turn, is fixedly connected to hood 14 for movement with the latter in the direction of arrow 16.

Air bag assembly 24 is shown in FIGS. 2 and 3 including a main rigid stem 38 having a base 40 serving as a mounting stud and a top end which supports an annular rubber bumper 42. The bumper is shown mounted to the top of stem 38 by suitable means such as bolt 44 and cooperating washer 46 which is bonded to the bumpers underside. In addition, the stem 38 defines a manifold system consisting of an axial passageway 48 which extends up into the stem from its underside through base 40 and radial passageways 50 extending from the central passageway to the outer side of the stem. As will be seen hereinafter with respect to FIG. 7, central passageway 48 is in fluid communication to a supply of air under pressure by means of air supply hose 52.

In addition to the various components making up air bag assembly 24 described thus far, the air bag assembly includes an inflatable air bag 54 which is constructed of rubber or other suitable resilient material. The air bad extends entirely around an axially extending intermediate segment of stem 38 so as to define an inner compartment 56 surrounding radial passageways 50. The top and bottom ends of the air bag are fixedly connected to the stem by o-rings 58 and 60 or other suitable means which connect these ends of the air bag to the stem in a fluid sealing fashion. Thus, the air bag can be inflated by causing air under pressure to enter the compartment 56 through passagways 48 and 50 and the air bag can be deflated positively by drawing air out of the compartment or by allowing it to leak out through passageways 48 and 50.

As illustrated in FIG. 3, the entire air bag assembly is mounted to a fixed base 62 forming part of cab 12 by means of base 40, which, as stated above, serves as a mounting stud. In this way, the air supply hose 52 can be located in a fixed position in order to communicate with a suitable pressurized air supply, as diagramatically illustrated in FIG. 7.

Referring specifically to FIG. 1, the air bag assembly 24 and the housing 22 are mounted relative to one another so that the bumper 42 and air bag 54 enter the internal cavity 34 of the housing through inlet 32 as the hood 14 is moved from its opened position to the closed position illustrated in FIG. 1. As will be discussed below, this is only possible if the air bag is in its deflated condition. The rubber bumper serves as a shock absorber against the closed top side of the housing as the latter moves down on to the air bag assembly. The circumferential taper 30 serves to guide the housing around the air bag assembly.

As stated above, in order to position housing 22 over air bag assembly 24, it is necessary that the air bag itself be in a deflated state. This is because the air bag, when inflated, is substantially larger than the maximum cross section of inlet 32 and therefore could not enter the housing in its inflated state. On the other hand, once the air bag is positioned within the housing in its deflated state and then inflated, the air bag assembly and housing cannot be readily separated from one another, thereby forming a latch. In order to unlatch the two components, it is necessary to deflat the air bag first. The air bag is shown deflated in FIG. 6 and the housing is shown in the same Figure moving over and moving away from the air bag. FIG. 3 shows the overall arrangement in its latched state with the air bag in its inflated condition.

Figure 6:
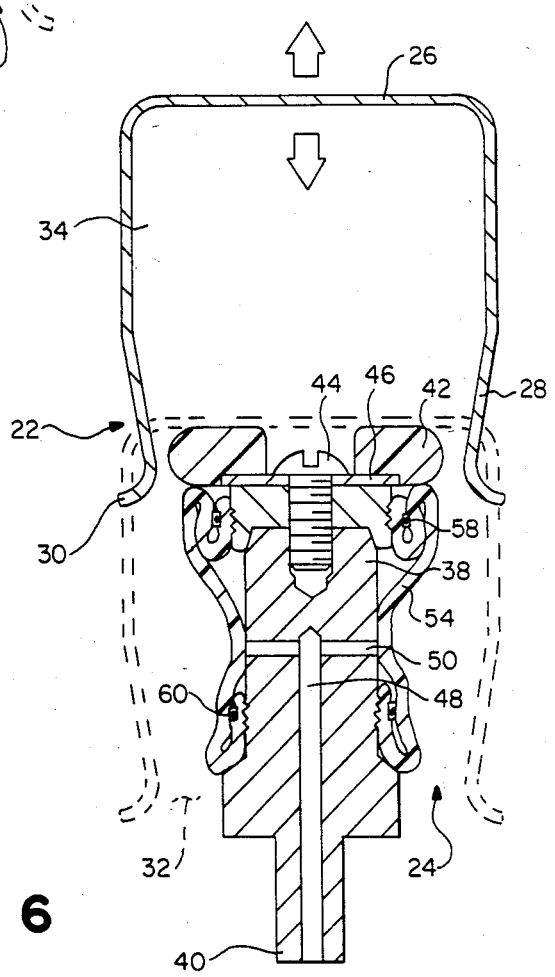
FIG. 6 is a vertical cross sectional view of the latching arrangement of FIG. 2 shown in an unlatched state.

There are a number of advantages to overall latching arrangement 18 over and above the previously discussed arrangements of the prior art. In the first place, because the housing 22 moves over and away from the air bag assembly while the air bag is deflated, as illustrated in FIG. 6, there is minimal (if any) friction between these two components as they move relative to one another since there is virtually no surface to surface contact between the two, except upon engagement of the top end of the housing by the rubber bumper. At the same time, because the inlet 32 into the cavity 34 of housing 22 is substantially larger than the maximum cross section of the air bag assembly when the air bag is deflated, the housing easily moves over and around the air bag assembly even if there are slight misalignments between these two components. Thus, it may be that the air bag assembly is not centrally located relative to the housing as the latter moves over the assembly. Nevertheless, within limits, the housing easily finds its way into position over the air bag assembly so long as the air bag remains deflated.

Figure 4:
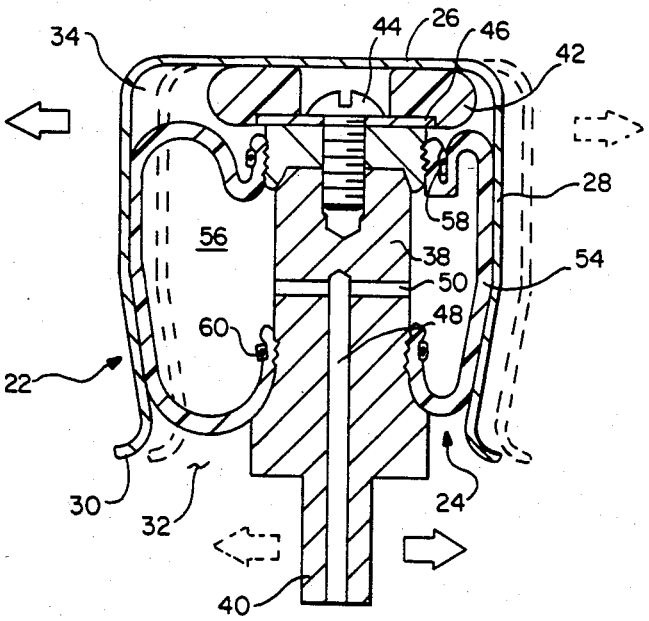
FIGS. 4 and 5 are views similar to FIG. 3, illustrating the latching arrangements ability to displace to a limited extent laterally and axially, respectively, in response to movement of the vehicle.
Figure 5:
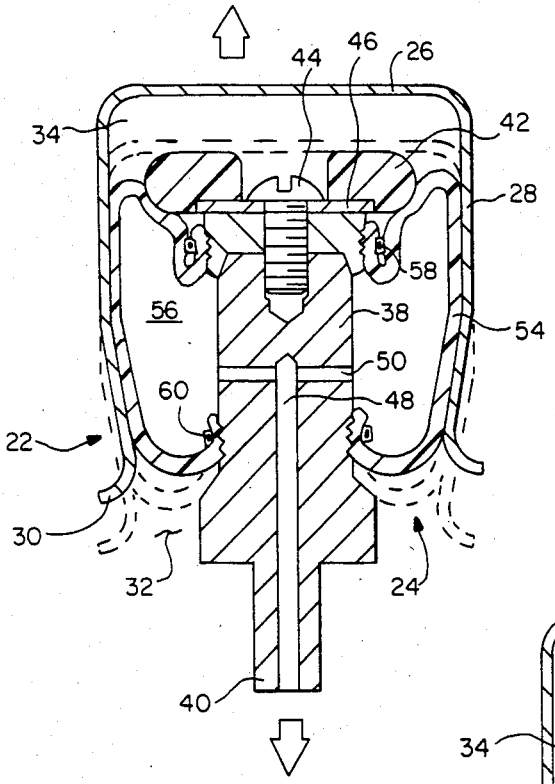

Once the overall arrangement is latched by inflating the air bag after housing 22 is located over the air bag assembly, the housing nevertheless is able to move to a limited extent laterally and axially relative to the air bag assembly. The lateral or radial displacement of the housing relative to the air bag assembly is illustrated in FIG. 4 and its axial displacement is illustrated in FIG. 5. This displacement capability allows the hood to move relative to the rest of the cab, to a limited extent, due to jarring of the overall vehicle without placing undue stress or otherwise adversely affecting the latching arrangement.

While the overall latching arrangement 18 has been described in conjunction with a motor vehicle and a hood and cab in particular, it is to be undersood that the arrangement can be utilized to latch together other components or members. Also, while it is preferable to inflate and deflate air bag 54 pneumatically, that is, utilizing pressurized air, it is to be understood that other types of pressurized fluid could be utilized. Moreover, the bag itself could be deflated merely by removing the pressurized air from within or a positive vacuum could be created to positively draw air or other such fluid out of the air bag. Any suitable source of air or other such fluid under pressure could be readily provided.

Figure 7:
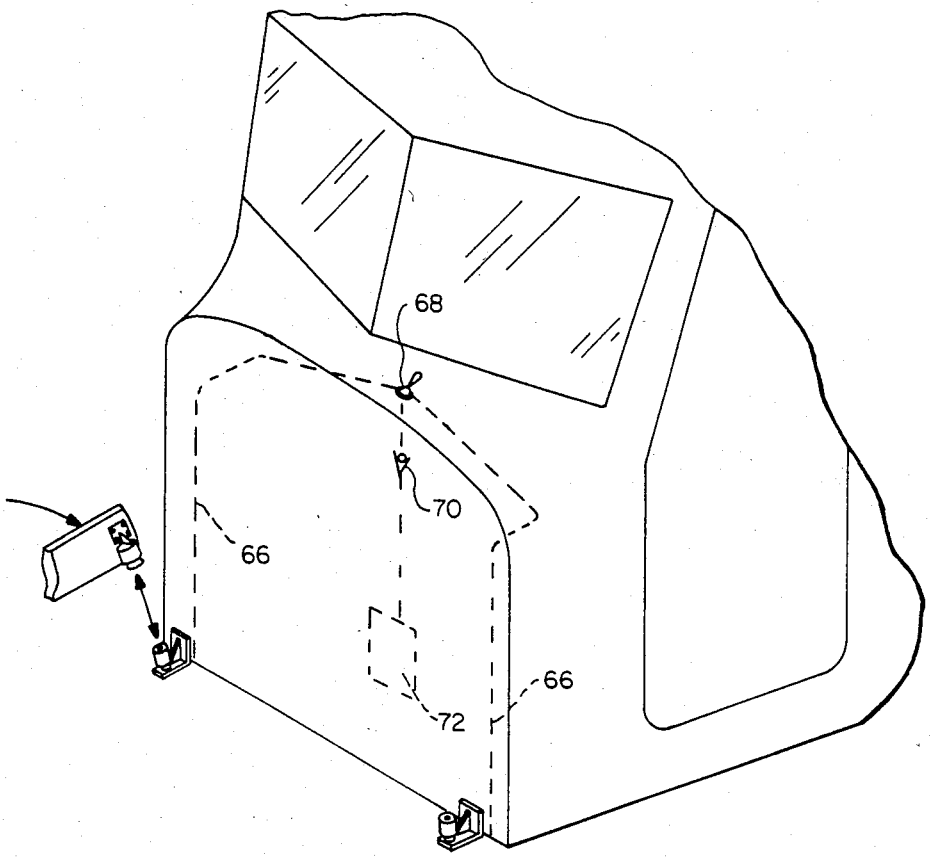
FIGS. 7 and 8 diagrammatically illustrate how the latching arrangement of FIG. 2 may be powered.
Figure 8:
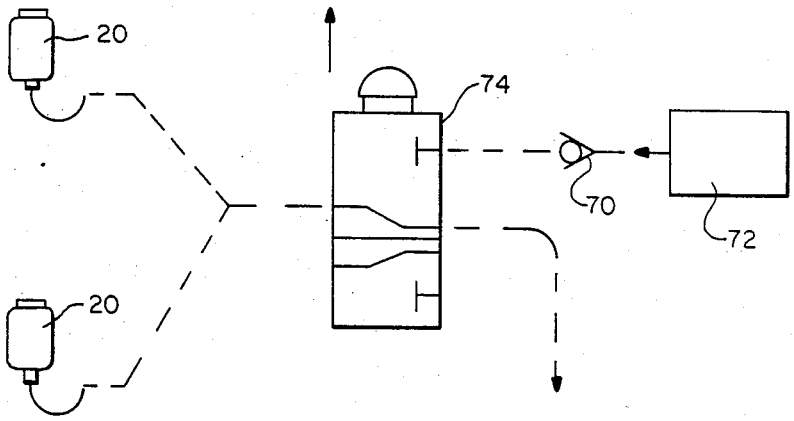

Referring specifically to FIG. 7, a housing 22 is shown mounted to a substructure for movement over and away from a cooperating air bag assembly 24 which is mounted to the base of a cab. In this particular system, two latching arrangements are utilized, although one housing 22 is illustrated. Both air bag assemblies are shown connected via air supply lines indicated by dotted lines at 66 through a suitable switch 68 in the cab and a check valve 70 to a supply of pressurized air diagrammatically indicated at 72. The purpose of the check valve 70 is to prevent the fluid from communicating back to the pressurized air source 72 once the air bags are activated. This will then prevent the air bags from deflating when the air supply source 72 is not pressurized, such as the case when a vehicle has not been in operation. In order to release the pressurized fluid from the air bags, a valve switch located between the check valve and the air bag can be used to exhaust the fluid from the system. This is best illustrated in FIG. 8 where the valve switch is shown at 74.

What is claimed is:

1. In an apparatus including first and second members, at least one of which is movable relative to the other such that the members can be placed in one position adjacent each other or another spaced-apart position, an arrangement for latching and unlatching said members when the latter are in said adjacent positions, said arrangement comprising:

(a) means including a fluid inflatable component carried by said first member, said component being designed to operate between an inflated condition and a deflated condition;

(b) means including an externally accessable cavity carried by said second member for receiving said inflatable component within said cavity when said component is in its deflated condition and said first and second members are in said adjacent position, said inflatable component and said cavity being configured such that the two cannot be separated from one another readily when said component is in its inflated condition within the cavity; and (c) means for controllably inflating and deflating said component when the latter is in said cavity, whereby to latch and unlatch said members;

(d) said apparatus being a motorized vehicle and said members including a frame and movable hood forming part of said vehicle, whereby said arrangement serves to latch and unlatch said hood with said frame.

2. An arrangement according to claim 1 wherein said inflatable component is an air bag and said means for inflating said air bag includes a source of air under pressure.

3. An arrangement according to claim 1 wherein said means including said inflatable component includes a resilient bumper fixedly connected with said component between the latter and cavity including means.

4. An arrangement according to claim 1 wherein said cavity including means includes a rigid housing containing said cavity and opened at one end for providing access into the housing by said inflatable component.

5. In an apparatus including first and second members, at least one of which is movable relative to the other such that the members can be placed in one position adjacent each other or another spaced-apart position, an arrangement for latching and unlatching said members when the latter are in said adjacent positions, said arrangement comprising:

(a) a first sub-arrangement including an air bag designed to operate between an inflated condition and a deflated condition, means including a base for fixedly connecting said air bag to said first member adjacent an underside section of said air bag, and a rubber bumper fixedly mounted to said air bag opposite said base;

(b) a second sub-arrangement including a relatively rigid housing closed at one end and opened at an opposite end for gaining access into an internal cavity defined by the housing, and means for fixedly connecting said housing with said second member for receiving said bumper and air bag within said cavity through said opening when said air bag is in its deflated condition and said first and second members are in said adjacent position, said air bag and cavity being configured such that the two cannot be separated from one another readily when said air bag is in its inflated condition within the cavity; and (c) means including a supply of air under pressure for controllably inflating and deflating said air bag when the latter is in said cavity, whereby to latch and unlatch said members.

6. An arrangement according to claim 5 wherein said housing includes and annular section around the opening into its cavity, said annular section tapering outwardly so as to act as a guide for said air bag as the latter is caused to enter said cavity.

7. An arrangement according to claim 5 wherein said apparatus is a motorized vehicle and said members are a frame and movable hood forming part of said vehicle, whereby said arrangement serves to latch and unlatch the hood with said frame.

8. A method of latching together and unlatching two members consisting of a frame and movable hood forming part of a motorized vehicle, comprising the steps of:

(a) fixedly connecting a means defining an externally accessable internal cavity with one of said members;

(b) fixedly connecting a fluid inflatable means to the other of said members;

(c) while said fluid inflatable member is in a deflated state, positioning it within said cavity;

(d) while said deflated fluid inflatable means is within said cavity, causing it to inflate sufficient to prevent its removal from said cavity, whereby to latch said members together; and (e) deflating said inflated means while the latter is in said cavity in order to remove it from said cavity and thereby unlatch said members.

9. In an apparatus including first and second members, at least one of which is movable relative to the other such that the members can be placed in one position adjacent each other or another spaced-apart position, an arrangement for latching and unlatching said members when the latter are in said adjacent positions, said arrangement comprising:

(a) means including a fluid inflatable component carried by said first member, said component being designed to operate between an inflated condition and a deflated condition;

(b) means including an externally accessable cavity carried by said second member for receiving said inflatable component within said cavity when said component is in its deflated condition and said first and second members are in said adjacent position, said inflatable component and said cavity being configured such that the two cannot be separated from one another readily when said component is in its inflated condition within the cavity; and (c) means for controllably inflating and deflating said component when the latter is in said cavity, whereby to latch and unlatch said members; and (d) said means including said inflatable component also including a resilient bumper fixedly connected with said component between the latter and said cavity including means.

* * * * *